US012054930B2

(12) United States Patent
Yuan et al.

(10) Patent No.: US 12,054,930 B2
(45) Date of Patent: Aug. 6, 2024

(54) CONNECTION ASSEMBLY FOR TOILET

(71) Applicant: Globe Union Industrial Corp., Taichung (TW)

(72) Inventors: Chia-Hua Yuan, Taichung (TW); His-Tsung Chen, Taichung (TW)

(73) Assignee: Globe Union Industrial Corp., Taichung (TW)

( * ) Notice: Subject to any disclaimer, the term of this patent is extended or adjusted under 35 U.S.C. 154(b) by 104 days.

(21) Appl. No.: 18/077,487

(22) Filed: Dec. 8, 2022

(65) Prior Publication Data

US 2023/0203799 A1 Jun. 29, 2023

(30) Foreign Application Priority Data

Oct. 14, 2021 (CN) ..... 202122480869.9

(51) Int. Cl.
*E03D 11/16* (2006.01)

(52) U.S. Cl.
CPC ..... *E03D 11/16* (2013.01)

(58) Field of Classification Search
CPC ..... E03D 11/16
See application file for complete search history.

(56) References Cited

U.S. PATENT DOCUMENTS 5,421,036 A 6/1995 Stevens et al.
6,065,160 A 5/2000 Winn
6,634,034 B2 10/2003 Rendell
8,281,421 B2 10/2012 Hughes
9,863,133 B2 * 1/2018 Edwards ..... E03D 11/16
2011/0173743 A1 * 7/2011 Jensen ..... E03D 11/16 4/420
2015/0322662 A1 * 11/2015 Schuster ..... F16B 5/0233 29/890.141

FOREIGN PATENT DOCUMENTS

TW 356153 U 4/1999
TW M448518 3/2013

* cited by examiner

*Primary Examiner* — Christine J Skubinna
(74) *Attorney, Agent, or Firm* — Best & Flanagan LLP

(57) ABSTRACT

A connection assembly for a toilet contains: a toilet flange, two positioning elements, two T-shaped screw nuts, two guiders, and two locking elements. The toilet flange is fixed on a floor of a building, and the toilet flange includes a hub, an annular fringe, two receiving grooves, two through orifices, and an elongated slot. A respective one positioning element includes a locating portion and two flexible wings. The locating portion has a passing orifice. A respective one T-shaped screw nut includes a head and a tubular. A respective one guider is removably fixed on the locating portion of to be received in a respective one fixing orifice of two fixing orifices of the toilet. A respective one locking element is screwed with the threaded orifice, after at least one part of the respective one guider is removed, and the toilet is locked on the toilet flange.

24 Claims, 19 Drawing Sheets

CONNECTION ASSEMBLY FOR TOILET

FIELD OF THE INVENTION

The present invention relates to a connection structure, and more particularly to a connection assembly for a toilet.

BACKGROUND OF THE INVENTION

Conventionally, a toilet is fixed in a wet fixing manner or a dry fixing manner. The wet fixing manner is to coat grout on a connection portion of a feces discharge tube and a drain orifice of the toilet and a connection portion of a bottom of the toilet and a floor, such that the toilet is fixed after the grout is solidified. TW Publication No. 356153 discloses the method of fixing the toilet in the wet fixing manner. To overcome above-mentioned defects, the toilet is fixed in the dry fixing manner, wherein a positioning plate is engaged on the feces discharge tube of the floor, and an expansion bolt is configured to screw the positioning plate on the floor, then the screw bolt on the positioning plate is inserted through two coupling orifices of two saddles of the toilet to screw with two screw nuts, thus fixing the toilet.

A fixing structure of a toilet is disclosed in TW Utility Model No. M448518. A toilet flange or a closet flange is disclosed in U.S. Pat. Nos. 5,421,036, 6,065,160, 6,634,034, 8,281,421 to fix the toilet on the floor of the building in the dry fixing manner.

The toilet flange is applicable for fixing the plumbing of the toilet so that the toilet is fixed on the floor and the drain orifice of the toilet is connected on the feces discharge tube of the floor, wherein the toilet flange contains a hub and a mounting flange, the hub is made of acrylonitrile butadiene styrene (ABS) or polyvinyl chloride (PVC), and the mounting flange is made of steel. In addition, the hub is made of metal or other plastic materials.

The toilet flange is connected on the feces discharge tube of the floor by using the hub so as to be fixed on the floor, and wax ring is sealed on a gap between the toilet flange and a bottom of the toilet, wherein the toilet includes two coupling orifices defined on the two saddles thereof so that two screw bolts are screwed with the two coupling orifices of the toilet.

The two screw bolts are inserted through the two coupling orifices to screw with two screw nuts so that the toilet is disposed on the toilet flange. However, a thickness of the floor is changeable based on different using requirements, so a height of the toilet flange is different from a height of a top of the floor, and a long screw bolt is applied to fix the toilet, but a part of the long screw bolt will extend out of the floor to cause poor appearance. Alternatively, the part of the long screw bolt is cut, thus having troublesome connection of the toilet.

In addition, the part of the screw bolt exposing outside the floor will cause corrosion.

The present invention has arisen to mitigate and/or obviate the afore-described disadvantages.

SUMMARY OF THE INVENTION

One aspect of the present invention is to provide a connection assembly for a toilet which is capable of fixing the toilet exactly, quickly, and securely and enhancing aesthetics appearance.

Further aspect of the present invention is to provide a connection assembly for a toilet by which the respective one locking element is screwed with the respective one T-shaped screw nut via the respective one fixing orifice of the toilet, so the length of the screw bolt of the respective one locking element is long to screw the screw bolt with the respective one T-shaped screw nut, the shank of the screw bolt of the respective one locking element is extended to locate below the toilet flange, thus preventing exposing of the shank to achieve the aesthetics appearance.

Another aspect of the present invention is to provide a connection assembly for a toilet by which the respective one guider is connected on the locating portion of the respective one positioning element so that when fixing the toilet, the respective one fixing orifice is aligned with and receives the respective one guider, and the toilet is fixed exactly and a part or all of the respective one guider is removed, the respective one locking element is screwed with the respective one T-shaped screw nut of the locating portion of the respective one positioning element to fix the toilet exactly and quickly.

To obtain above-mentioned aspects, a connection assembly for a toilet provided by the present invention contains: a toilet flange, two positioning elements, two T-shaped screw nuts, two guiders, and two locking elements.

The toilet flange is fixed on a floor of a building, and the toilet flange includes a hub configured to connect with a feces discharge tube, an annular fringe connected on a top of the hub, two receiving grooves defined on two opposite sides of the annular fringe, two through orifices formed on the two receiving grooves, and an elongated slot communicating with the two through orifices.

A respective one positioning element includes a locating portion and two flexible wings one-piece extending from two opposite sides of the locating portion of the respective one positioning element. The locating portion of the respective one positioning element has a passing orifice. A respective one flexible wing is configured to abut against a top fence of the toilet flange.

A respective one T-shaped screw nut includes a head and a tubular extension connected with the head, the head is limited to not rotate after being inserted through a respective one through orifice of a respective one receiving groove and is slid to a desired position by moving the tubular extension along the elongated slot of the respective one receiving groove, and the head is limited on a bottom fence of the elongated slot of the annular fringe; the tubular extension is fixed after extending the passing orifice of the respective one positioning element, and after the respective one flexible wing abuts against the top fence of the toilet flange, the respective one positioning element and the respective one T-shaped screw nut are forced by the respective one flexible wing to engage on the annular fringe.

A respective one guider is removably fixed on the locating portion of the respective one positioning element so as to be further received in a respective one fixing orifice of two fixing orifices of the toilet.

A respective one locking element is screwed with the threaded orifice of the respective one T-shaped screw nut, after at least one part of the respective one guider is removed, and the toilet is locked on the toilet flange.

DETAILED DESCRIPTION OF THE PREFERRED EMBODIMENTS

Figure 1:
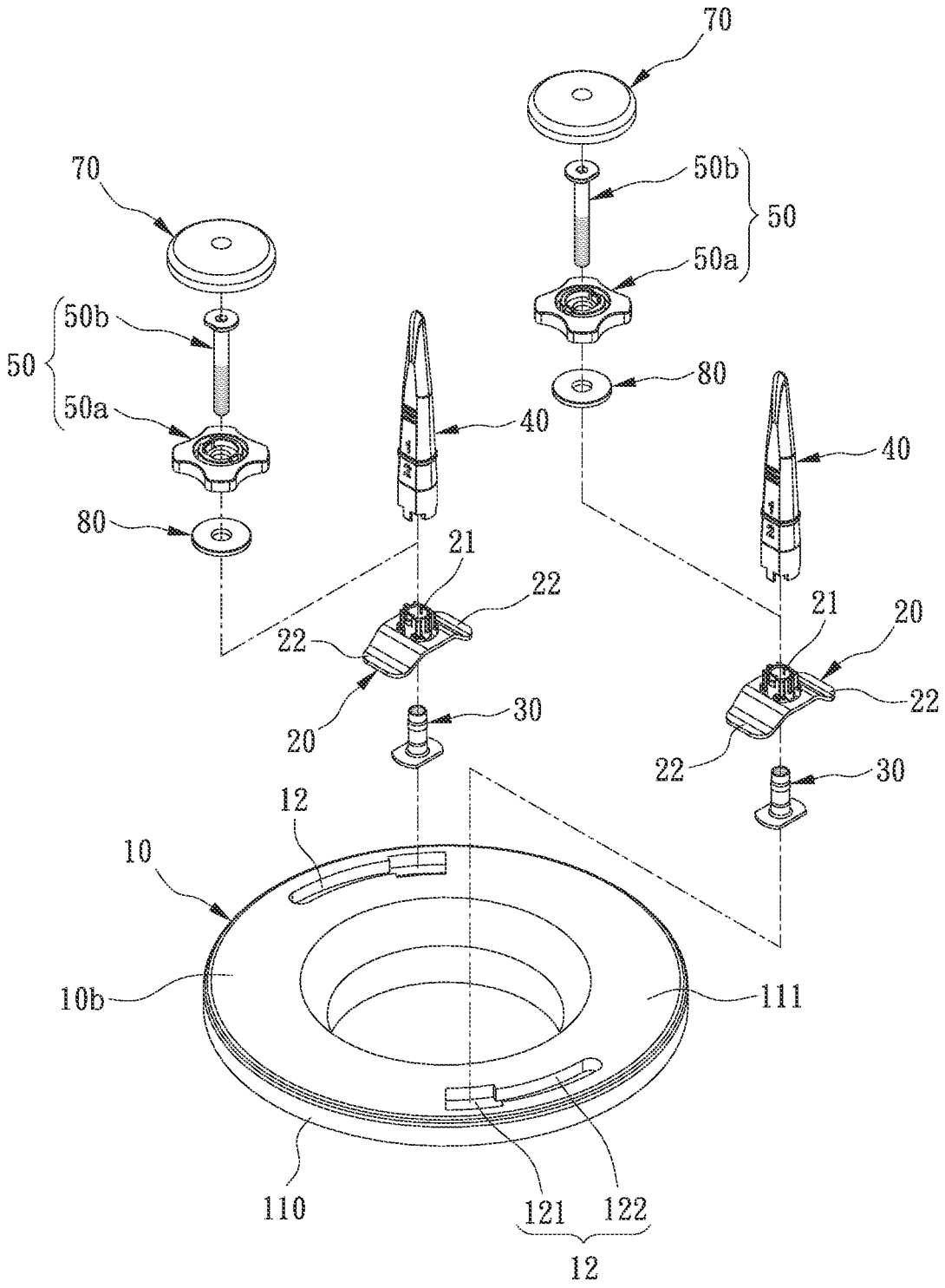
FIG. 1 is a perspective view showing the exploded components of a connection assembly for a toilet according to a first embodiment of the present invention.
Figure 2:
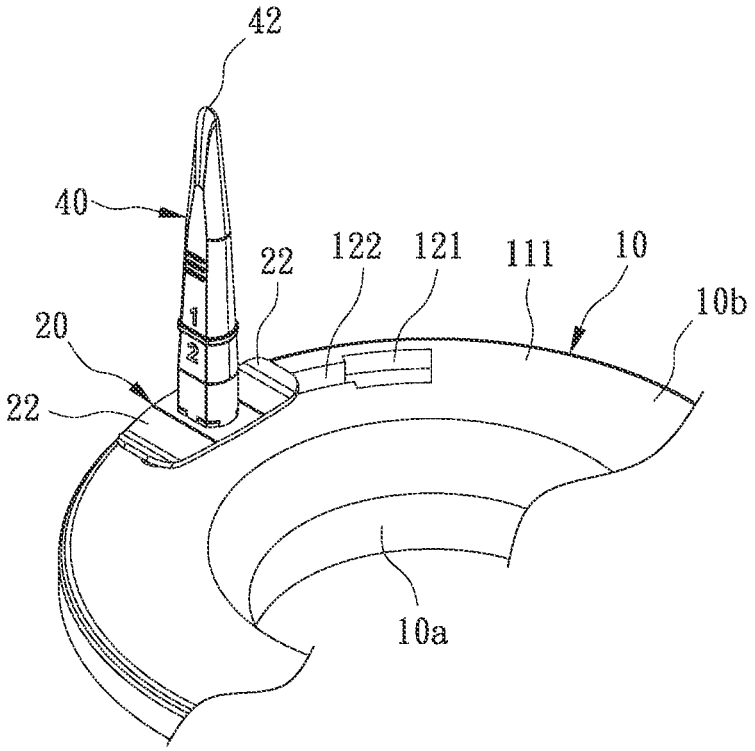
FIG. 2 is a perspective view showing the assembly of a part of the connection assembly for the toilet according to the first embodiment of the present invention.

With reference to FIGS. 1-5, a connection assembly for a toilet according to a first embodiment of the present invention comprises: a toilet flange 10, two positioning elements 20, two T-shaped screw nuts 30, two guiders 40, and two locking elements 50.

The toilet flange 10 is fixed on a floor 1 of a building, and the toilet flange 10 includes a hub 10*a* configured to connect with a feces discharge tube (not shown), an annular fringe 10*b* connected on a top of the hub 10*a*, two receiving grooves 12 defined on two opposite sides of the annular fringe 10*b*, two through orifices 121 formed on the two receiving grooves 12, and an elongated slot 122 communicating with the two through orifices 121. In this embodiment, the toilet flange 10 is locked on the floor 1 by multiple screws (not shown). Since such a locking structure is a well-known art, further remarks are omitted.

Referring to FIGS. 6-9, a respective one positioning element 20 includes a locating portion 21 and two flexible wings 22 one-piece extending from two opposite sides of the locating portion 21 of the respective one positioning element 20; the locating portion 21 of the respective one positioning element 20 has a passing orifice 211; a respective one flexible wing 22 is configured to abut against a top fence 111 of the toilet flange 10.

A respective one T-shaped screw nut 30 includes a head 31 and a tubular extension 32 connected with the head 31, wherein the head 31 is limited to not rotate after being inserted through a respective one through orifice 121 of a respective one receiving groove 12 and is slid to a desired position by moving the tubular extension 32 along the elongated slot 122 of the respective one receiving groove 12, and the head 31 is limited on a bottom fence 112 of the elongated slot 122 of the annular fringe 10*b*; the tubular extension 32 is fixed after extending into the passing orifice 211 of the respective one positioning element 20. The respective one T-shaped screw nut 30 further includes a threaded orifice 33.

The respective one T-shaped screw nut 30 is connected with the locating portion 21 of the respective one positioning element 20 by using the tubular extension 32, such that the respective one positioning element 20 is moved by using the respective one T-shaped screw nut 30 to fix on a predetermined position of the toilet flange 10. When the locating portion 21 of the respective one positioning element 20 is slidably moved to the predetermined position at which a distance between the locating portion 21 of the respective one positioning element 20 and a vertical wall of the building is fixed so that the toilet 2 is secured relative to the vertical wall of the building exactly.

Figure 10:
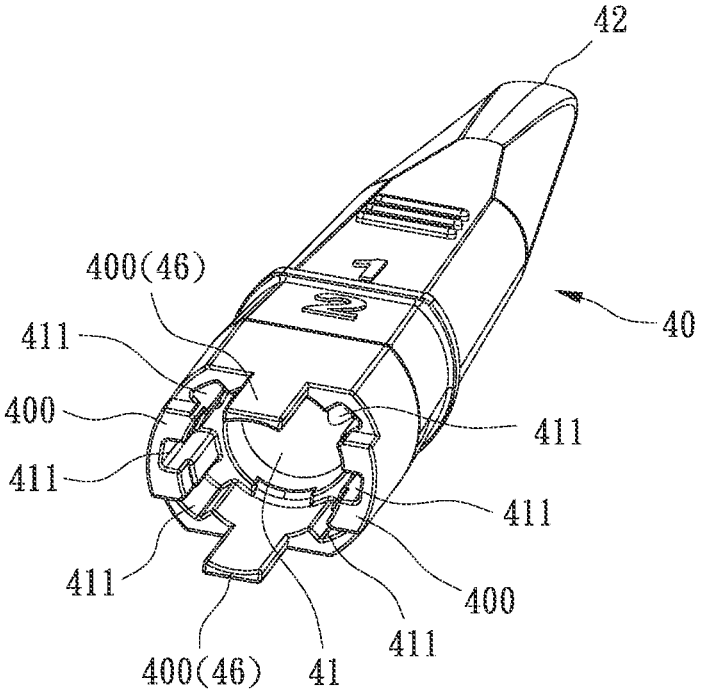
FIG. 10 is also another perspective view showing the assembly of a part of the connection assembly for the toilet according to the first embodiment of the present invention.
Figure 11:
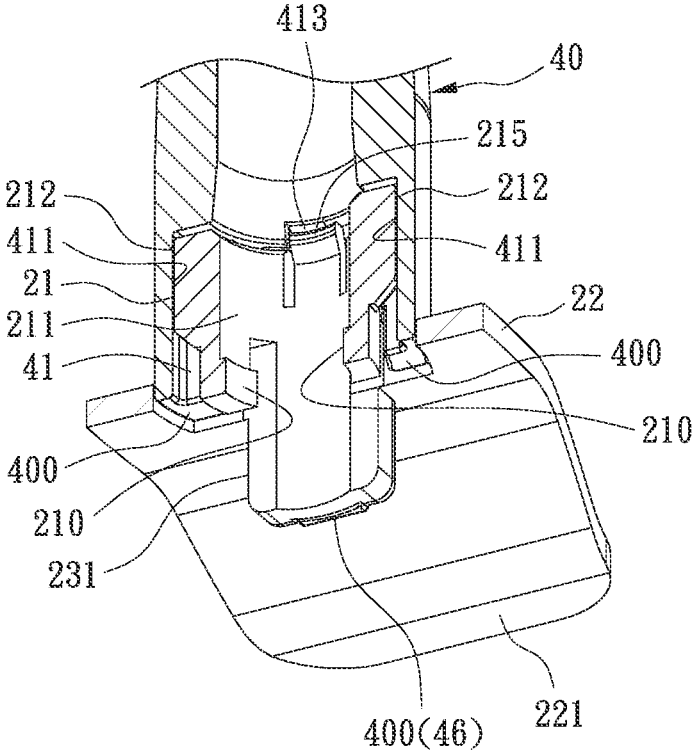
FIG. 11 is another cross-sectional perspective view showing the assembly of a part of the connection assembly for the toilet according to the first embodiment of the present invention.

As shown in FIGS. 10-11, a respective one guider 40 is a sole component and is removably fixed on the locating portion 21 of the respective one positioning element 20 so as to be further received in a respective one fixing orifice 2*a* of two fixing orifices 2*a* of the toilet 2.

As illustrated in FIGS. 12-15, a respective one locking element 50 is screwed with the threaded orifice 33 of the respective one T-shaped screw nut 30, after at least one part of the respective one guider 40 is removed, and the toilet 2 is locked on the toilet flange 10.

Figure 3:
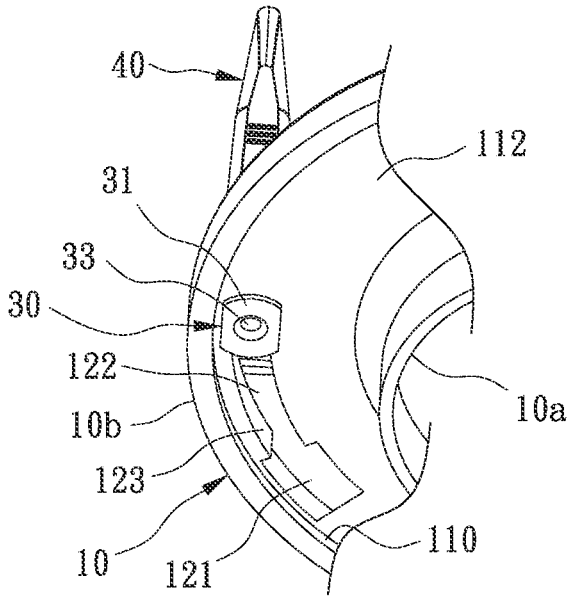
FIG. 3 is a side plan view showing the assembly of a part of the connection assembly for the toilet according to the first embodiment of the present invention.
Figure 4:
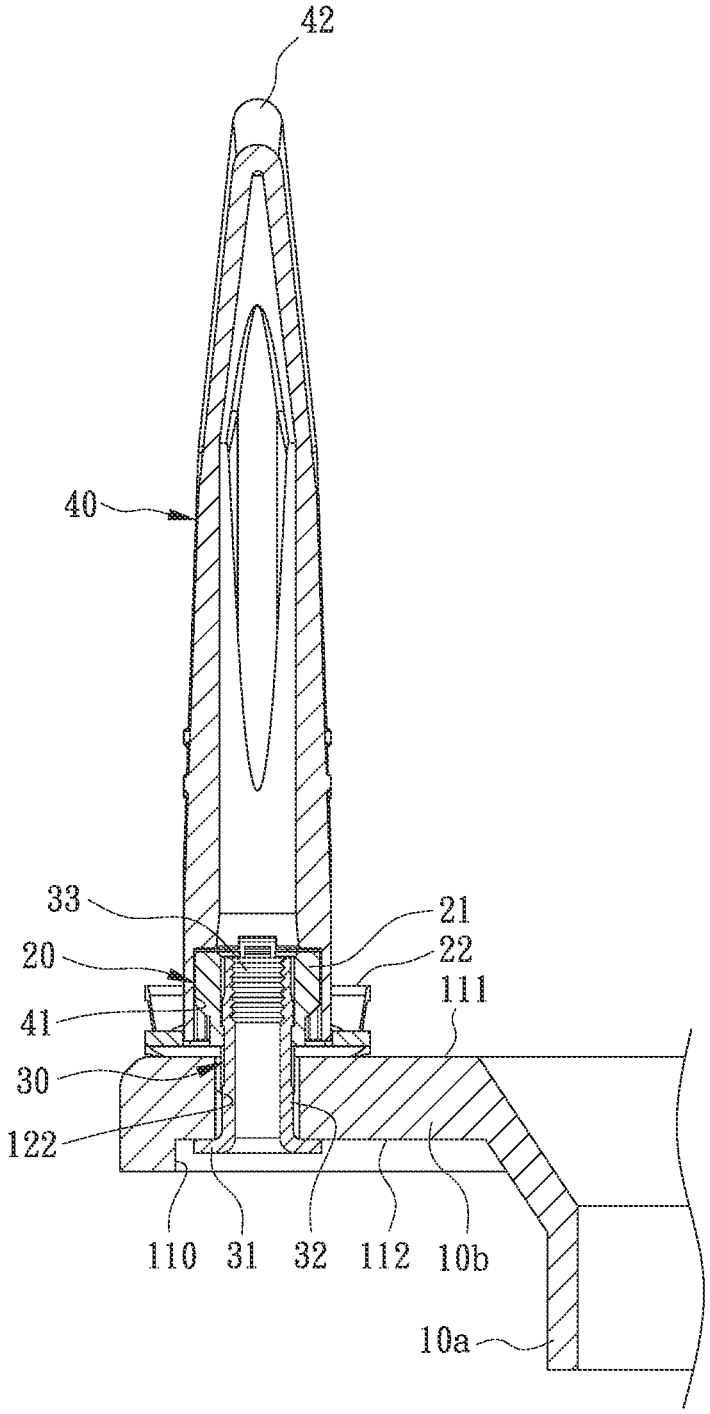
FIG. 4 is a cross sectional view showing the assembly of the connection assembly according to the first embodiment of the present invention.
Figure 7:
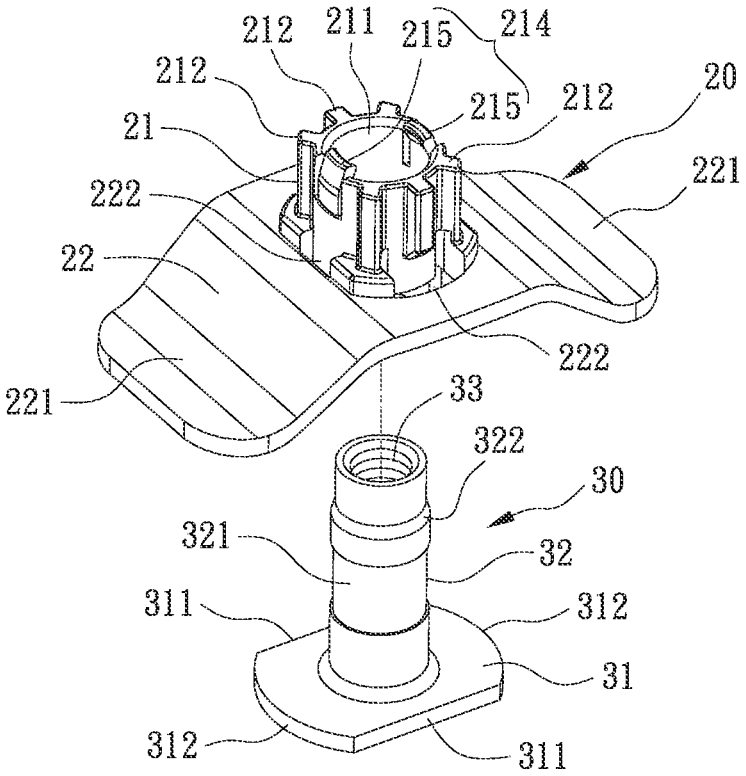
FIG. 7 is a perspective view showing the exploded components of a part of the connection assembly for the toilet according to the first embodiment of the present invention.

With reference to FIG. 7, the head 31 of the respective one T-shaped screw nut 30 has two long fringes 311 and two short fringe 312; the annular fringe 10*b* of the toilet flange 10 has a limiting cliff 110 extending downward from the annular fringe 10*b*, as shown in FIGS. 3 and 4, such that when the respective one locking element 50 is screwed with the threaded orifice 33 of the respective one T-shaped screw nut 30 and actuates the respective one T-shaped screw nut 30 to rotate, an inner wall of the limiting cliff 110 abuts against one of the two long fringes 311 of the head 31 of the respective one T-shaped screw nut 30, thus limiting a rotation of the respective one T-shaped screw nut 30. Thereby, the respective one locking element 50 is screwed with or is unscrewed from the respective one T-shaped screw nut 30.

Figure 9:
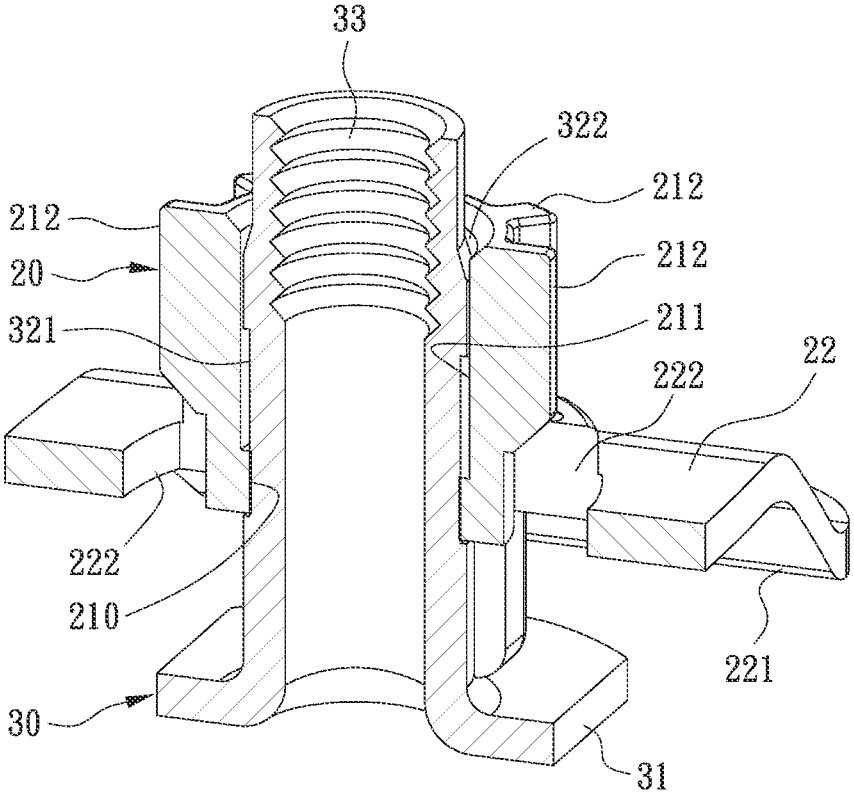
FIG. 9 is a cross-sectional perspective view showing the assembly of a part of the connection assembly for the toilet according to the first embodiment of the present invention.

Referring to FIGS. 7 and 9, the tubular extension 32 has a groove 321 defined on an outer wall thereof, and the passing orifice 211 of the locating portion 21 of the respective one positioning element 20 has at least two flexible hooks 210 extending from the passing orifice 211, such that after the tubular extension 32 moves into the passing orifice 211 of the respective one positioning element 20, the tubular extension 32 forces the at least two flexible hooks 210 to expand and to move into the groove 321, and after the at least two flexible hooks 210 retract flexibly, the at least two flexible hooks 210 engage with the groove 321. After the respective one T-shaped screw nut 30 is connected with the locating portion 21 of the respective one positioning element 20, the respective one T-shaped screw nut 30 is limited on the locating portion 21, thus facilitating a connection between the respective one T-shaped screw nut 30 and the respective one receiving groove 12 of the toilet flange 10.

The tubular extension 32 further has a tilted face 322 formed above the groove 321 and configured to guide the tubular extension 32 to expand a respective one flexible hook 210 of the at least two flexible hooks 210.

Figure 5:
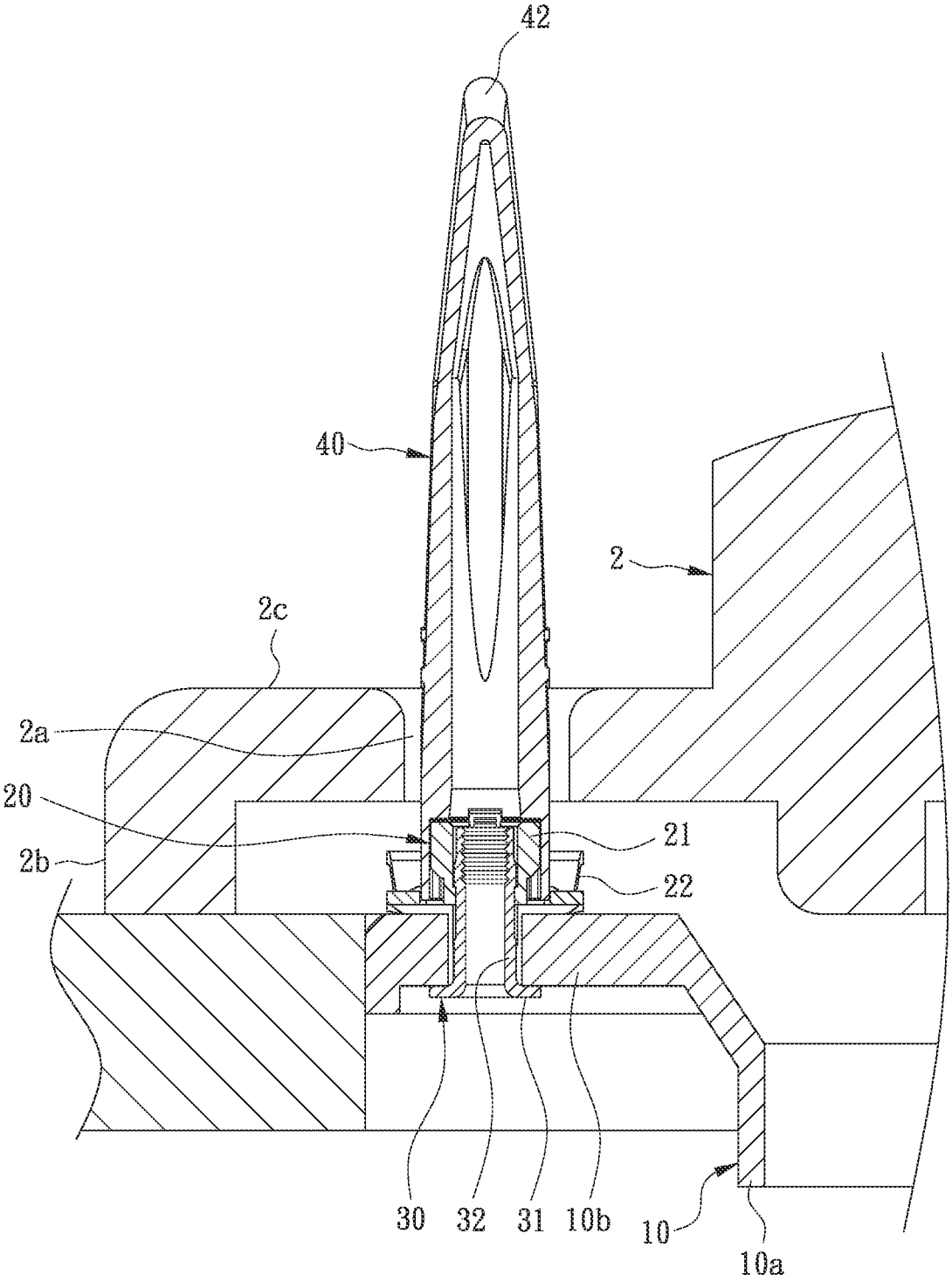
FIG. 5 is a cross sectional view showing the operation of the connection assembly and the toilet according to the first embodiment of the present invention.

The respective one guider 40 includes a notch 41 defined on a bottom thereof and engaged with the locating portion 21 of the respective one positioning element 20, and the respective one guider 40 includes a conical section 42 having a tip and configured to align with and guide the respective one fixing orifice 2*a* of the toilet 2, as shown in FIG. 5, and the respective one guider 40 is removed after the toilet 2 is fixed.

Figure 6:
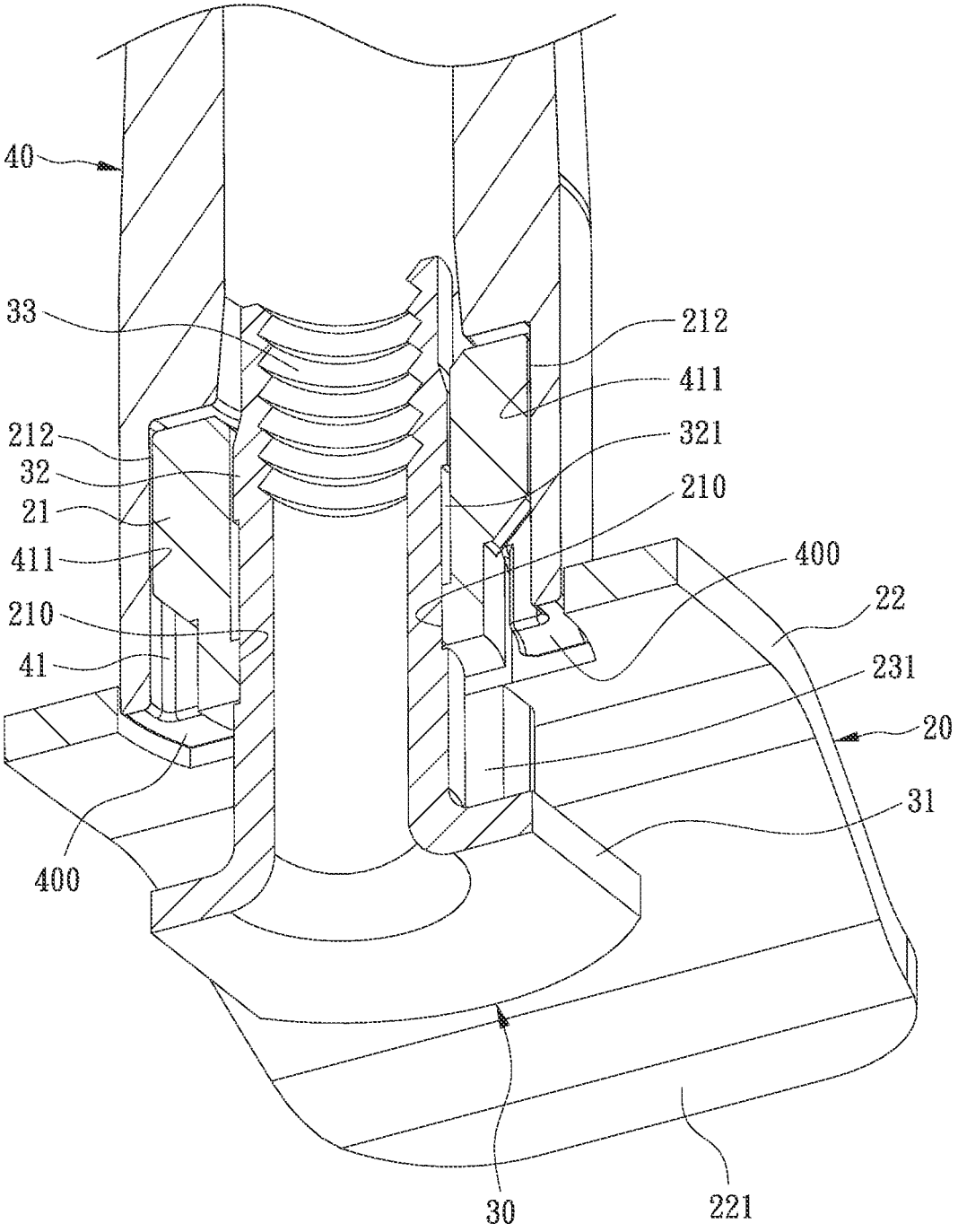
FIG. 6 is a cross-sectional perspective view showing the assembly of the connection assembly according to the first embodiment of the present invention.

With reference to FIGS. 6, 10 and 11, the notch 41 of the respective one guider 40 has multiple longitudinal recesses 411 defined on an inner wall thereof, for example, six longitudinal recesses 411 are defined on the inner wall of the notch 41, and the locating portion 21 of the respective one positioning element 20 has multiple vertical ribs 212 extending from an outer wall of the locating portion 21, for example, six vertical ribs 212 extend from the outer wall of the locating portion 21 and are configured to engage in the six longitudinal recesses 411. Thereby, the respective one guider 40 is fixed on the locating portion 21 of the respective one positioning element 20, and the locating portion 21 of the respective one positioning element 20 is detachable after fixing the toilet 2. In another embodiment, the six longitudinal recesses 411 defined on the outer wall of the locating portion 21, and six vertical ribs 212 extend from the inner wall of the notch 41 and are configured to engage in the six longitudinal recesses 411.

Figure 8:
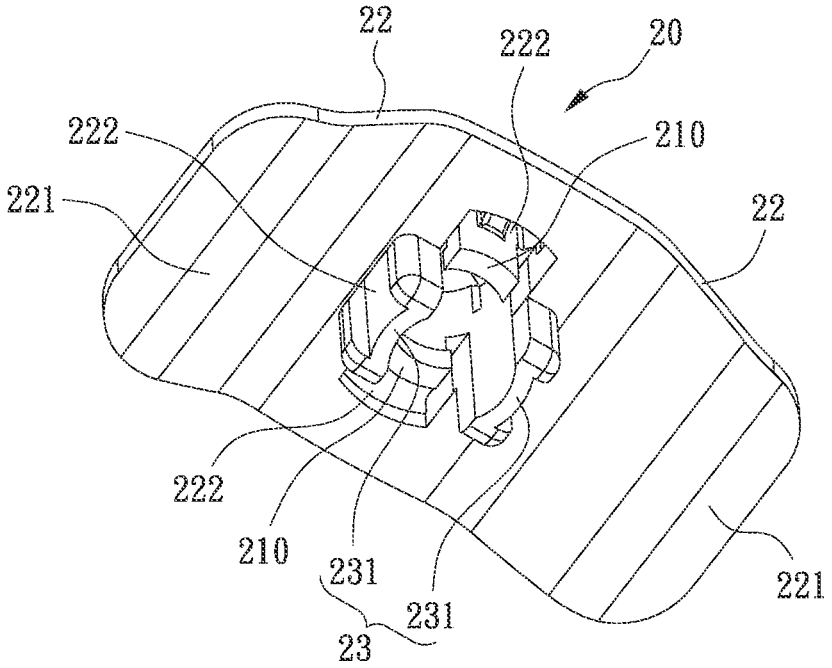
FIG. 8 is another perspective view showing the assembly of a part of the connection assembly for the toilet according to the first embodiment of the present invention.
Figure 12:
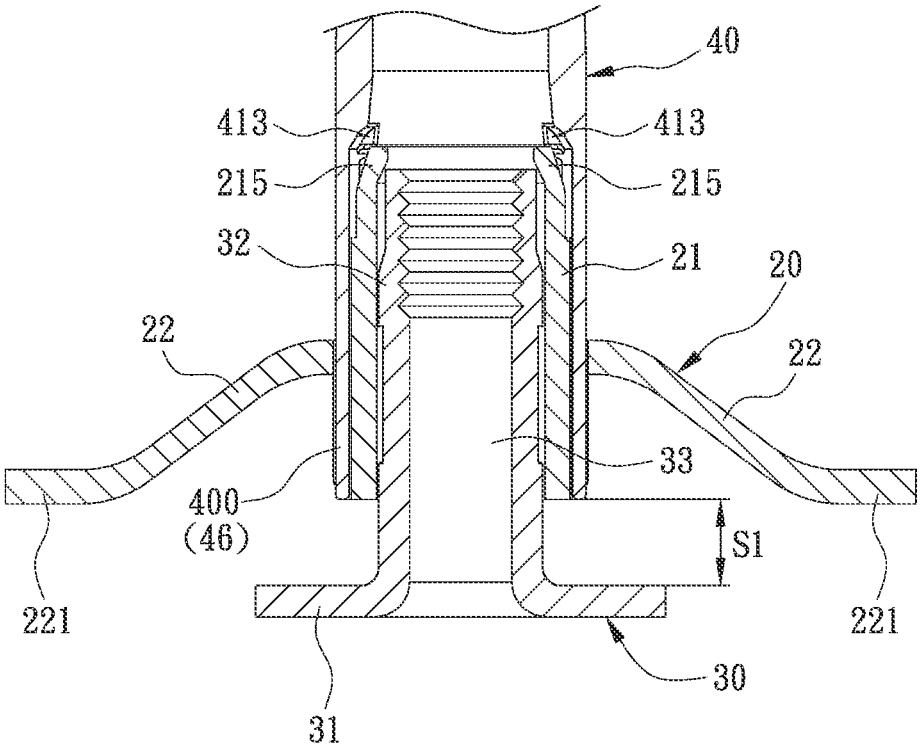
FIG. 12 is a cross sectional view showing the operation of a part of the connection assembly for the toilet according to the first embodiment of the present invention.

Referring to FIGS. 7, 8 and 12, the locating portion 21 of the respective one positioning element 20 is cylindrical, wherein the two flexible wings 22 extend from the two opposite sides of a middle section of an outer wall of the locating portion 21 and are formed in an arc shape or a bow shape, such that the respective one flexible wing 33 of the two flexible wings 22 has a support foot 221 formed adjacent to a distal end of the respective one flexible wing 33 so as to abut against the top fence 111 of the toilet flange 10.

Figure 13:
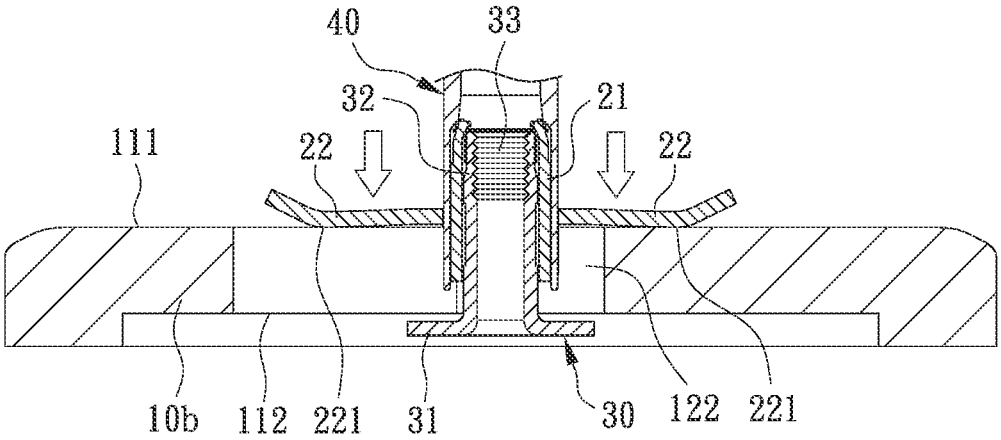
FIG. 13 is another cross sectional view showing the operation of a part of the connection assembly for the toilet according to the first embodiment of the present invention.
Figure 14:
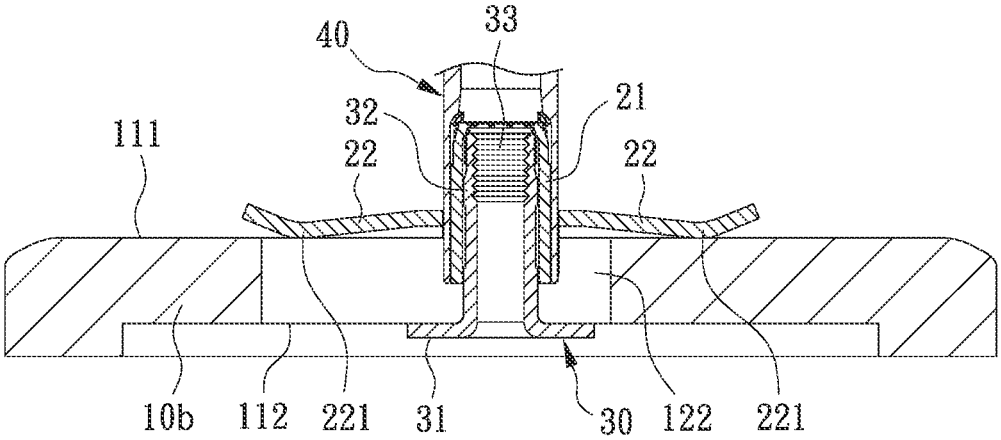
FIG. 14 is also another cross sectional view showing the operation of a part of the connection assembly for the toilet according to the first embodiment of the present invention.

When the locating portion 21 is pressed, the respective one flexible wing 22 deforms flatly, as shown in FIG. 13, and the respective one positioning element 20 and the respective one T-shaped screw nut 30 are slid into the elongated slot 122 of the respective one receiving groove 12, when the respective one positioning element 20 is removed, the locating portion 21 of the respective one positioning element 20 actuates the respective one T-shaped screw nut 30 to move upward, hence the head 31 moves upward to abut against the bottom fence 112 of the elongated slot 122 of the respective one receiving groove 12, and the respective one flexible wing 22 of the respective one positioning element 20 and the head 31 of the respective one T-shaped screw nut 30 are fixed on the annular fringe 10*b* of the toilet flange 10, as illustrated in FIG. 14.

With reference to FIGS. 7-10, the respective one flexible wing 22 of the respective one positioning element 20 has multiple cutouts 222 surrounding the locating portion 21, for example, four cutouts 222 surround the locating portion 21 of the respective one positioning element 20; the notch 41 of the respective one guider 40 has multiple tabs 400 extending downward therearound, for example, four tabs 400 extend downward around the notch 41 of the respective one guider 40 and are configured to be received in the four cutouts 222, thus connecting the respective guider 40 with the respective one positioning element 20 firmly.

With reference to FIG. 8, the locating portion 21 of the respective one positioning element 20 further has a central defining portion 23 formed on a bottom of the locating portion 21 and configured to be received in the elongated slot 122 of the respective one receiving groove 12, thus limiting a rotation of the respective one positioning element 20. The locating portion 21 of the respective one positioning element 20 has two central protrusions 231 one-piece extending from two opposite sides of the bottom of the locating portion 21, and the central defining portion 23 is defined by the two central protrusions 231, wherein a respective one central protrusion 231 of the two central protrusions 231 is limited on a peripheral face 123 of the elongated slot 122 of the respective one receiving groove 12, as shown in FIG. 3. A gap is defined between the respective one central protrusion 231 and the elongated slot 122 of the respective one receiving groove 12 so that the respective one positioning element 20 rotates within a certain angular range in the elongated slot 122 of the respective one receiving groove 12 after being received in the elongated slot 122.

Figure 15:
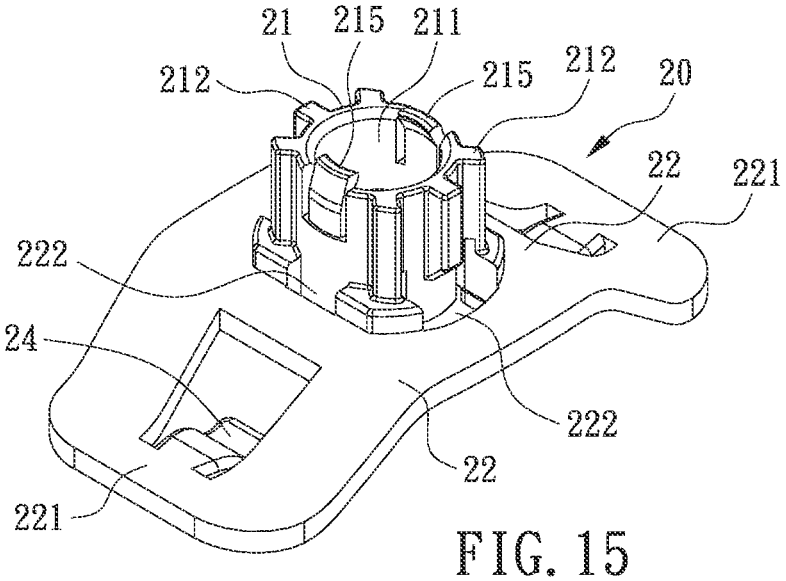
FIG. 15 is a perspective view showing the assembly of a part of a connection assembly for a toilet according to a second embodiment of the present invention.
Figure 16:
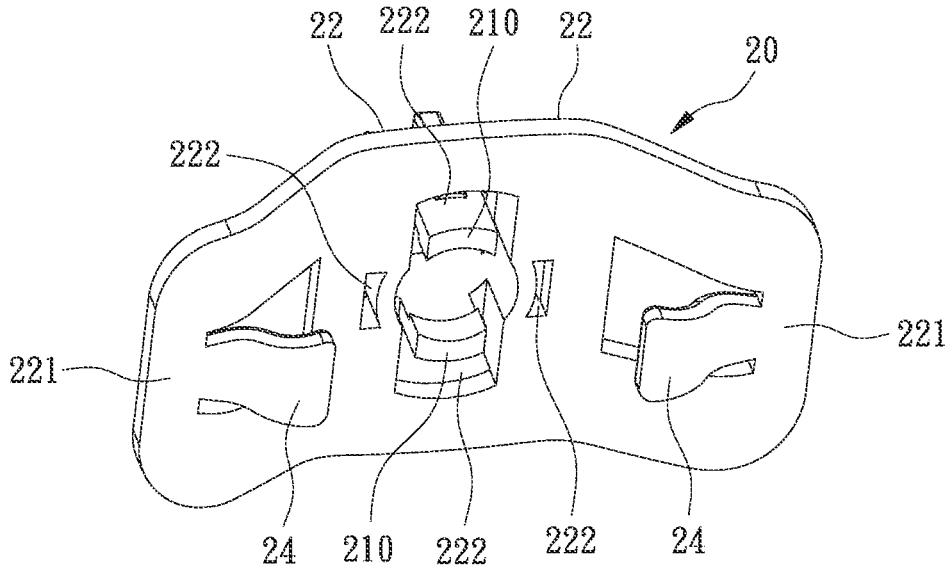
FIG. 16 is another perspective view showing the assembly of a part of the connection assembly for the toilet according to the second embodiment of the present invention.

In a second embodiment, the respective one flexible wing 22 of the respective one positioning element 20 has a limitation projection 24, as illustrated in FIGS. 15 and 16, and the limitation projection 24 is configured to be received in the elongated slot 122 of the respective one receiving groove 12 and contacts with the peripheral face 123 of the elongated slot 122, thus limiting the rotation of the respective one positioning element 20, wherein a gap is defined between the limitation projection 24 and the elongated slot 122 so that the respective one positioning element 20 is rotated within a certain angular range in the elongated slot 122.

Figure 17:
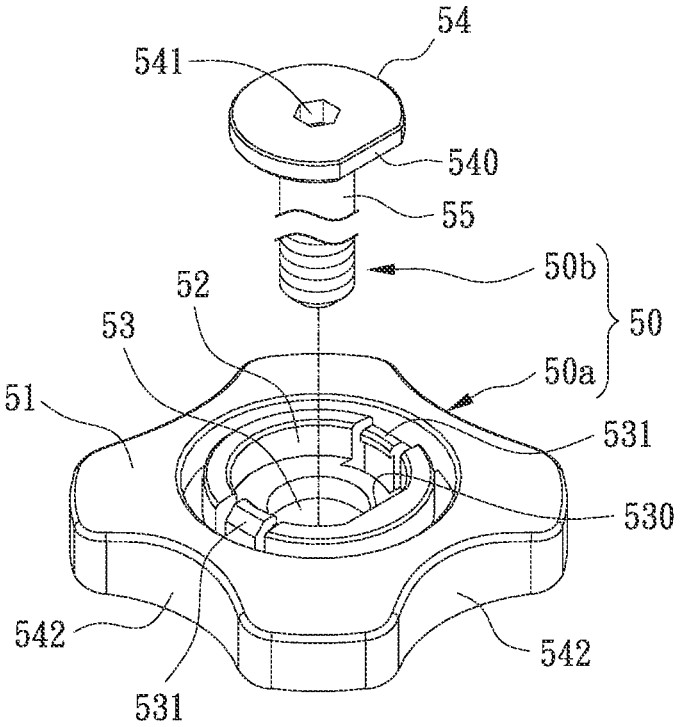
FIG. 17 is a perspective view showing the exploded components of a part of the connection assembly for the toilet according to the first embodiment of the present invention.
Figure 18:
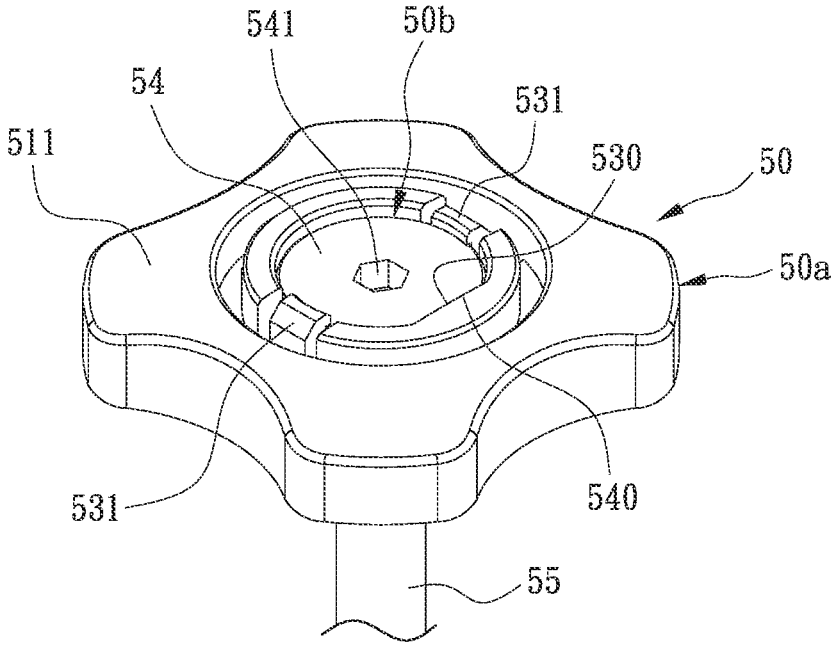
FIG. 18 is a perspective view showing the assembly of a part of the connection assembly for the toilet according to the first embodiment of the present invention.
Figure 19:
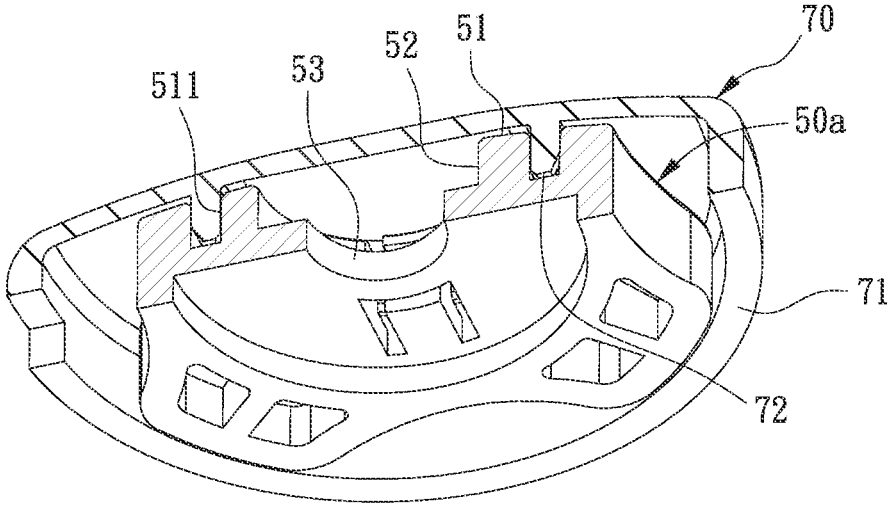
FIG. 19 is a cross-sectional perspective view showing the assembly of a part of the connection assembly for the toilet according to the first embodiment of the present invention.

Referring to FIGS. 17-19, the respective one locking element 50 includes a rotary knob 50*a* and a screw bolt 50*b*. A top fence 51 of the rotary knob 50*a* has an accommodation trench 52 defined thereon, and the accommodation trench 52 has an aperture 53; the screw bolt 50*b* has a head 54 and a shank 55; the shank 55 is inserted through the aperture 53 of the accommodation trench 52 of the rotary knob 50*a* and is screwed with the respective one T-shape screw nut 30; the head 54 is limited in the accommodation trench 52 to not rotate, for example, the head 54 of the screw bolt 50*b* is non-circular or has a tangent plane 540, wherein a profile of the accommodation trench 52 mates with a profile of the head 54 so that the head 54 is matingly engaged in the accommodation trench 52. Alternatively, a limitation face 530 is defined in the aperture 53 of the rotary knob 50*a* to contact with the tangent plane 540, such that the head 54 is fixed and does not rotate so that the rotary knob 50*a* actuates the screw bolt 50*b* to revolve. Thereby, the rotary knob 50*a* is rotated manually to actuate the screw bolt 50*b* to revolve, thus locking the screw bolt 50*b*. Thereafter, an L-shaped wrench is applied to rotate the screw bolt 50*b* tightly.

The head 54 of the screw bolt 50*b* has a polygonal slot 541 configured to receive a specific hand tool, such that the screw bolt 50*b* is engaged and rotated by using the polygonal slot 541 and the specific hand tool. In this embodiment, the rotary knob 50*a* is integrally injection molded from plastic materials, and the rotary knob 50*a* has multiple recessed portions 542 so that a user grasps the rotary knob 50*a* securely, wherein the screw bolt 50*b* is made of metal material to reinforce a structure and a locking capacity of the screw bolt 50*b*.

With reference to FIGS. 17 and 18, the rotary knob 50*a* includes at least two flexible hooks 531 formed around the accommodation trench 52 of the rotary knob 50*a* so that the at least two flexible hooks 531 hook the head 53 in the accommodation trench 52 of the respective one locking element 50 after the head 54 forces the at least two flexible hooks 54 to expand, thus avoiding a removal of the rotary knob 50*a* from the screw bolt 50*b* and facilitating screwing of the respective one locking element 50.

Referring to FIGS. the connection assembly for the toilet further comprises two decoration caps 70, wherein a respective one decoration cap 70 is engaged on the top fence 51 of the rotary knob 50*a* so that at least one part of the top fence 51 of the rotary knob 50*a* is covered in the respective one decoration cap 70 with the head 54 of the screw bolt 50*b* of the respective one locking element 50. Thereby, the rotary knob 50*a* is further configured to facilitate positioning of the respective one decoration cap 70. Preferably, the respective one decoration cap 70 enhances an aesthetics appearance and a tight sealing effect to avoid a corrosion of the head 54.

The top fence 51 of the rotary knob 50*a* has a surrounding trench 511 defined thereon; the respective one decoration cap 70 includes an external fence 71 and an extending rib 72 extending from an inner side of a bottom of the external fence 71 and configured to engage in the surrounding trench 511, wherein the external fence 71 is located outside the rotary knob 50*a* so that the rotary knob 50*a* is covered in the respective one decoration cap 70 with the head 54 of the screw bolt 50*b*, thus enhancing the aesthetics appearance and obtain the tight sealing effect.

Figure 20:
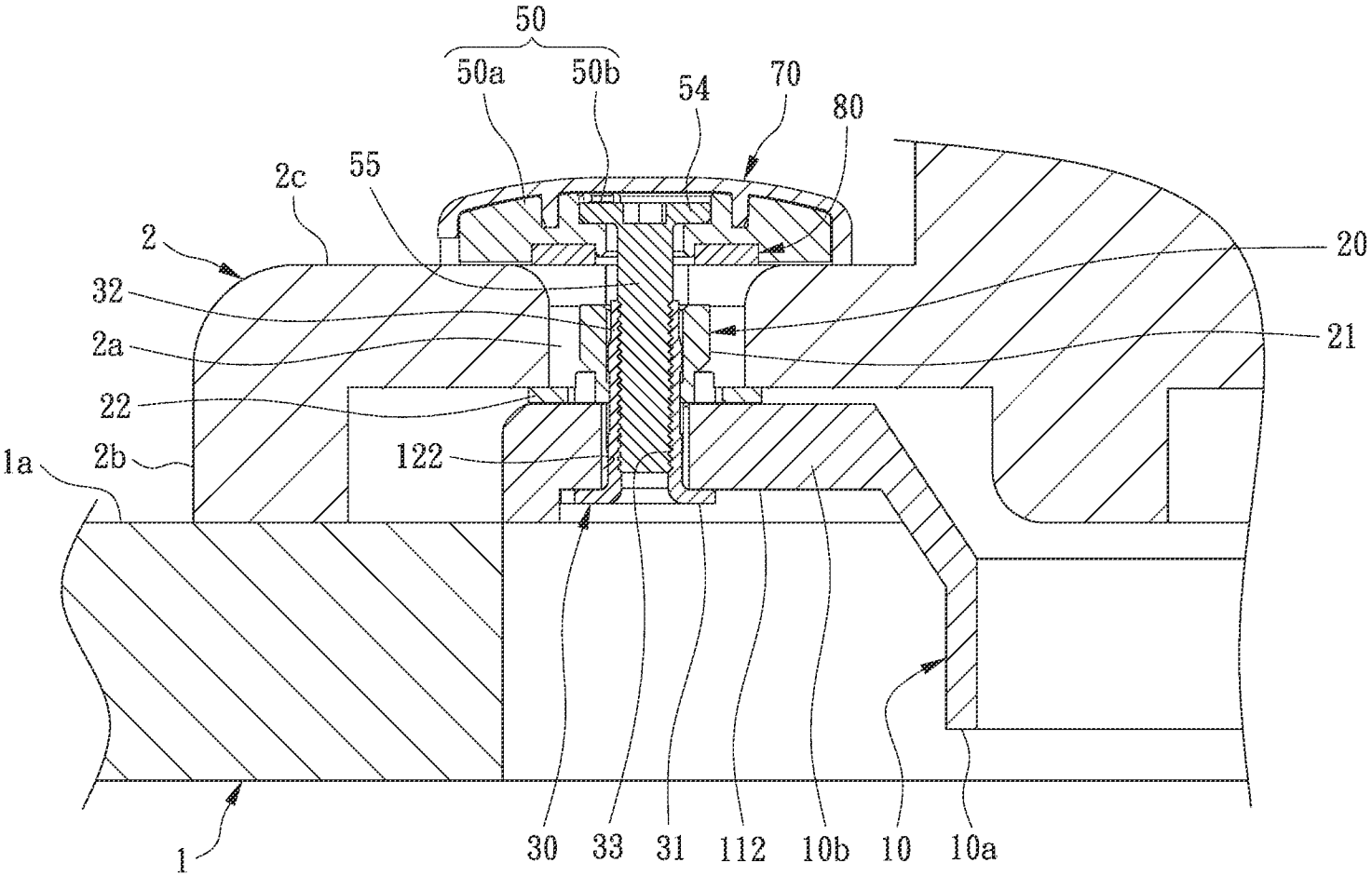
FIG. 20 is still another cross sectional view showing the operation of a part of the connection assembly for the toilet according to the first embodiment of the present invention.

As shown in FIGS. 1 and 20, the connection assembly of the present invention further comprises: two washers 80, and a respective one washer 80 is fitted on the shank 55 of the screw bolt 50*b* of the respective one locking element 50, such that when the screw bolt 50*b* is screwed with the respective one flexible wing 33 of the respective one T-shaped screw nut 30 via the respective one fixing orifice 2*a* of the toilet 2, and the respective one washer 80 is defined between the head 54 of the screw bolt 50*b* and the respective one fixing orifice 2*a* of the toilet 2, thus fixing the toilet 2 firmly.

The respective one fixing orifice 2*a* of the toilet 2 is elongated and extending along two horizontal sides of the toilet 2, hence the respective one washer 80 is defined ahead of or behind the respective one fixing orifice 2*a*.

Figure 21:
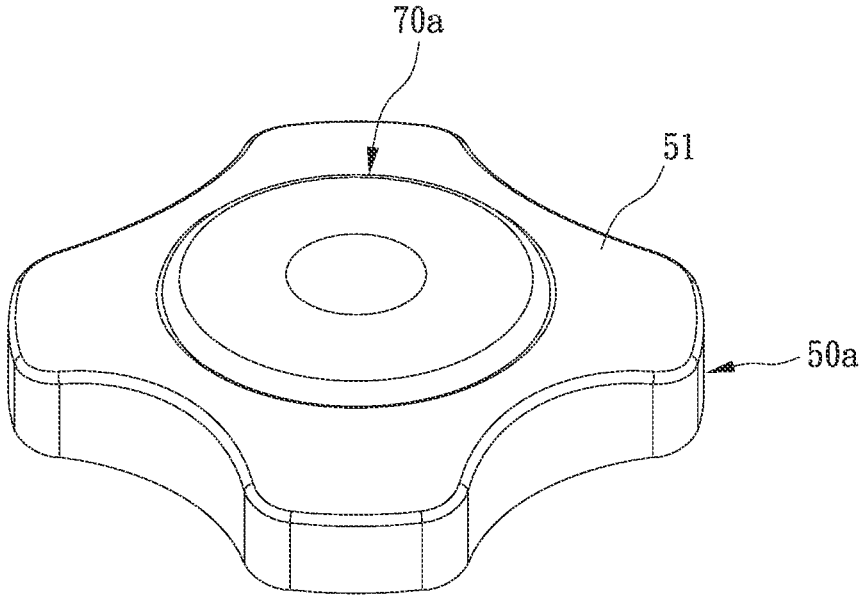
FIG. 21 is a perspective view showing the assembly of a part of the connection assembly for the toilet according to the first embodiment of the present invention.
Figure 22:
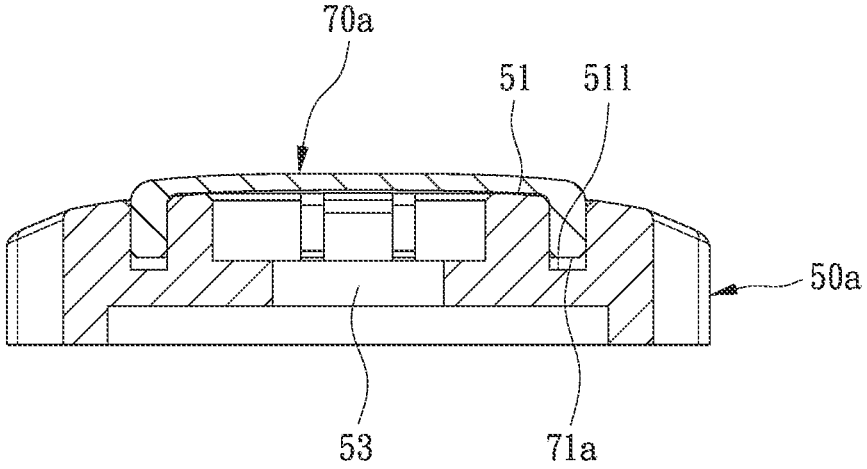
FIG. 22 is a cross sectional view showing the assembly of a part of the connection assembly for the toilet according to the first embodiment of the present invention.

With reference to FIGS. 21 and 22, a size of the respective one decoration cap 70*a* of the second embodiment is less than a size of the respective one decoration cap 70 of the first embodiment, hence the respective one decoration cap 70*s* of this embodiment is directly engaged in the surrounding trench 511, the respective one decoration cap 70*a* includes an external fence 71*a* with a diameter less than a diameter of the external fence 71 of the respective decoration cap 70 so that the external fence 71*a* is directly engaged in the surrounding trench 511, hence the respective one decoration cap 70*a* does not cover the rotary knob 50*a* completely, but a part of the rotary knob 50*a* is covered by the respective one decoration cap 70*a* with the head 54 of the screw bolt 50*b*, thus achieving aesthetics appearance and tight sealing effect.

Figure 23:
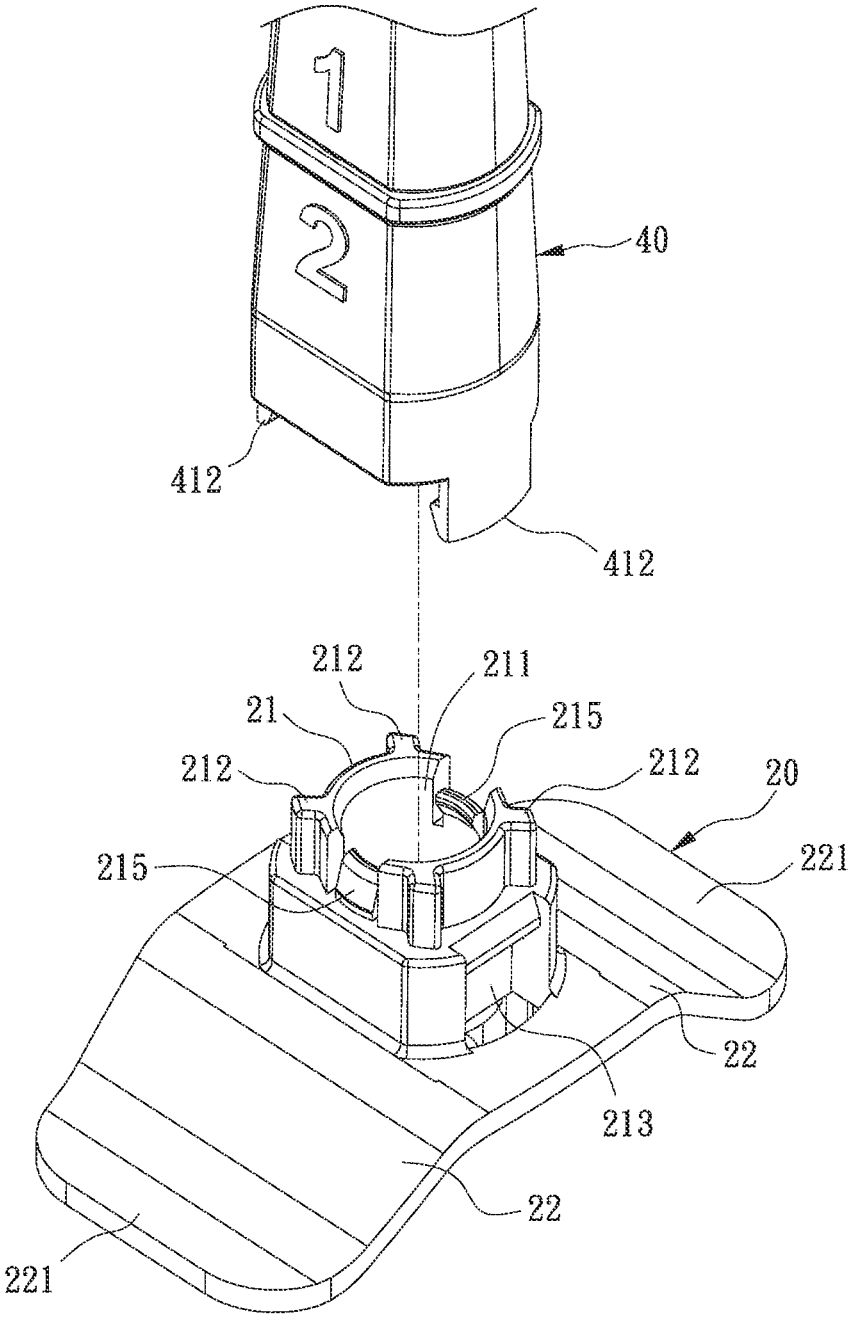
FIG. 23 is a perspective view showing the exploded components of a part of a connection assembly for a toilet according to a third embodiment of the present invention.
Figure 24:
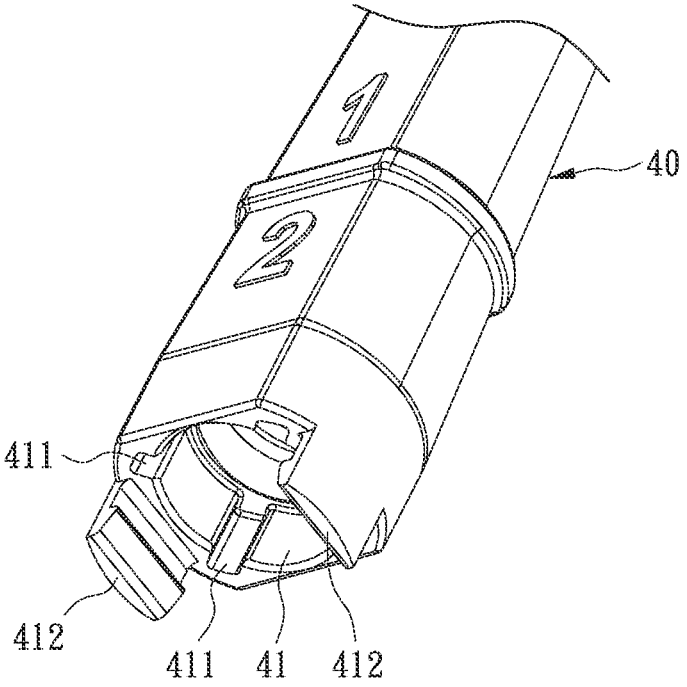
FIG. 24 is a perspective view showing the assembly of a part of the connection assembly for the toilet according to the third embodiment of the present invention.
Figure 25:
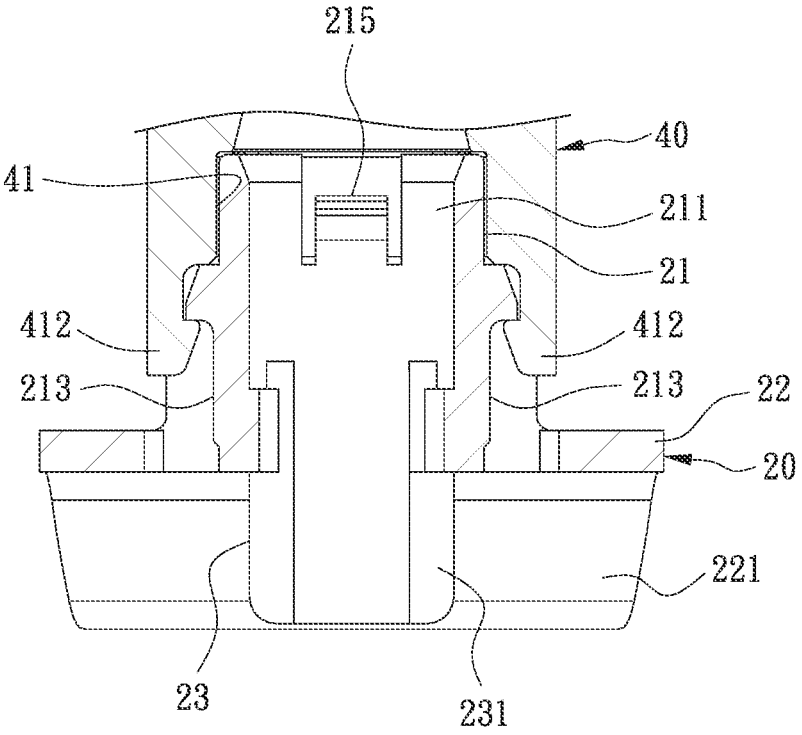
FIG. 25 is a cross sectional view showing the assembly of a part of the connection assembly for the toilet according to the third embodiment of the present invention.

In the third embodiment, the notch 41 of the respective one guider 40 has at least two flexible hooks 412 formed on at least two sides of the notch 41, as shown in FIGS. 23-25, and the locating portion 21 of the respective one positioning element 20 has at least two depressions 213 formed on at least two opposite outer walls of the locating portion 21 and configured to engage with the at least two flexible hooks 412. Thereby, the respective one guider 40 is fitted on the locating portion 21 downward, and a respective one flexible hook 412 is flexibly engaged in a respective one depression 213, thus connecting the respective one guider 40 and the respective one positioning element 20 quickly. In contracts, the respective one guider 40 is forced to pull out upward and to remove from the one positioning element 20.

In another embodiment, the locating portion 21 of the respective one positioning element 20 has the multiple vertical ribs 212 of the first embodiment, for example, the locating portion 21 of the respective one positioning element 20 has four vertical ribs 212, and the four longitudinal recesses 411 are defined on the inner wall of the notch 41 so that four vertical ribs 212 are engaged in the four longitudinal recesses 411, thus connecting the locating portion 21 of the respective one positioning element 20 with the respective one guider 40.

Figure 26:
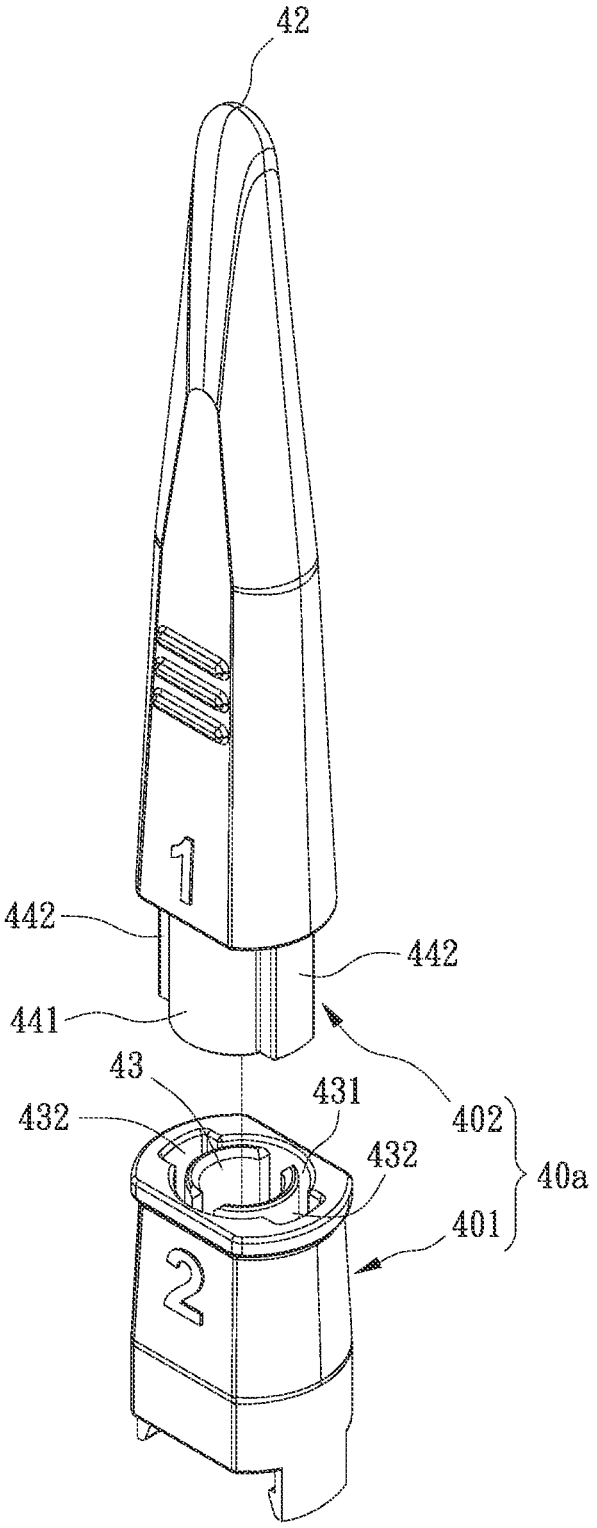
FIG. 26 is a perspective view showing the exploded components of a part of a connection assembly for a toilet according to a fourth embodiment of the present invention.
Figure 27:
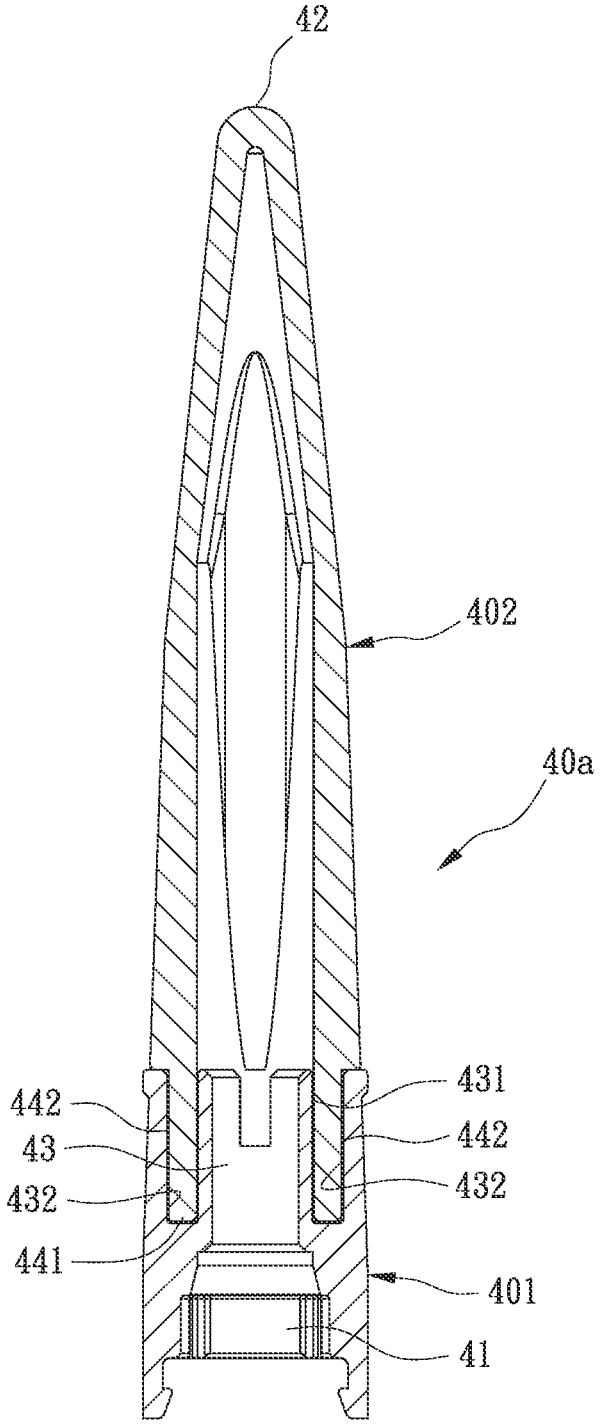
FIG. 27 is a cross sectional view showing the assembly of a part of the connection assembly for the toilet according to the fourth embodiment of the present invention.

In a fourth embodiment, as shown in FIGS. 26 and 27, a respective one guider 40*a* includes two components, i.e., a tubular seat 401 and a guiding seat 402 removably connected on the tubular seat 401; the tubular seat 401 has a conducting orifice 43 configured to guide the shank 55 of the screw bolt 50*b* of the respective one locking element 50, and the tubular seat 401 has the notch 41 defined below and communicating with the conducting orifice 43, such that the notch 41 is fitted on the locating portion 21 of the respective one positioning element 20, thus connecting respective one guider 40*a* with the respective one positioning element 20.

The guiding seat 402 has the conical section 42 configured to align with and to pass through the respective one fixing orifice 2*a* of the toilet 2. It is to be noted that the guiding seat 402 is removed and the tubular seat 401 is maintained, after fixing the toilet 2.

Figure 28:
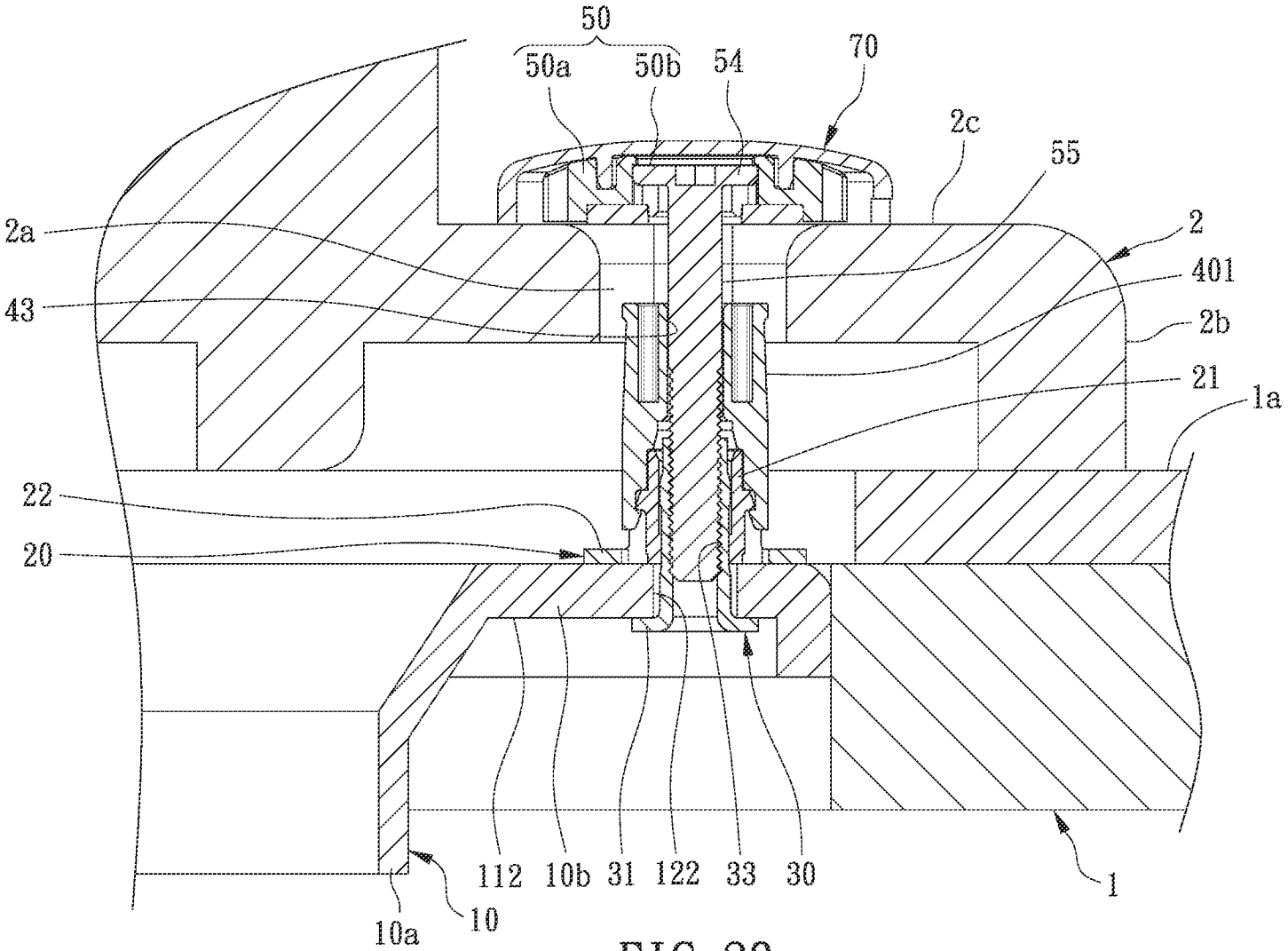
FIG. 28 is a cross sectional view showing the operation of the connection assembly for the toilet according to the fourth embodiment of the present invention.

The toilet flange 10 is fixed on the floor 1 of the building, but thicknesses of various floors are different, so when a base 2*b* of the toilet 2 contacts with a top face 1*a* of the floor 1, a distance between two saddles 2*c* of two sides of the toilet 2 and the toilet flange 10 is different. When the distance between two saddles 2*c* of two sides of the toilet 2 and the toilet flange 10 is short, the respective one guider 40 is applicable. When the distance between the two saddles 2*c* of the toilet 2 and the toilet flange is long, the respective one guider 40*a* is applicable, and the tubular seat 401 is maintained after the toilet 2 is fixed, as shown in FIG. 28, such that the screw bolt 50*b* is guided by the conducting orifice 43 of the tubular seat 401 to move to the threaded orifice 33 of the respective one T-shaped screw nut 30, thus screwing the screw bolt 50*b* with the respective one T-shaped screw nut 30.

Alternatively, the tubular seat 401 is maintained or the respective one guider 40*a* is detachable based on using requirements.

The tubular seat 401 has a retaining trench 431 defined on a top thereof and surrounding the conducting orifice 43, and two vertical trenches 432 formed on two opposite sides of the retaining trench 431, the guiding seat 402 has an engagement cliff 441 extending on a bottom thereof, and the guiding seat 402 has two longitudinal protrusions 442 extending from two opposite sides of an outer wall of the engagement cliff 441 so that the guiding seat 402 is engaged in the retaining trench 431 by using the engagement cliff 441, and the two longitudinal protrusions 442 are slidably received in the two vertical trenches 432 so that the guiding seat 402 is limited to rotate and engage on the tubular seat 401. Thereafter, the guiding seat 402 is alternatively pulled to remove from the tubular seat 401 after the toilet 2 is positioned.

A length of the screw bolt 50*b* of the respective one locking element 50 is changeably designed based on the using requirements.

To move the head 31 of the respective one T-shaped screw nut 30 to the bottom fence 112 of the elongated slot 122 via the respective one through orifice 121 of the toilet flange 10 smoothly and does not contact with an inner wall of the respective one through orifice 121, as illustrated in FIGS. 12 to 15, the notch 41 of the respective one guider 40 has an abutting portion 413 formed proximate to a top of the notch 41, and the locating portion 21 of the respective one positioning element 20 has a flexible retracting portion 214 formed on a top of the locating portion 21, such that when the locating portion 21 of the respective one positioning element 20 is pressed, the abutting portion 413 abuts against the flexible retracting portion 214 to stop the tubular extension 32 of the respective one T-shaped screw nut 30, so a smallest fixing distance 51 between the head 31 and the locating portion 21 produces so that the respective one T-shaped screw nut 30 is screwed on the elongated slot 122 of the toilet flange 10. The flexible retracting portion 214 is comprised of two flexible blocks 215.

Figure 29:
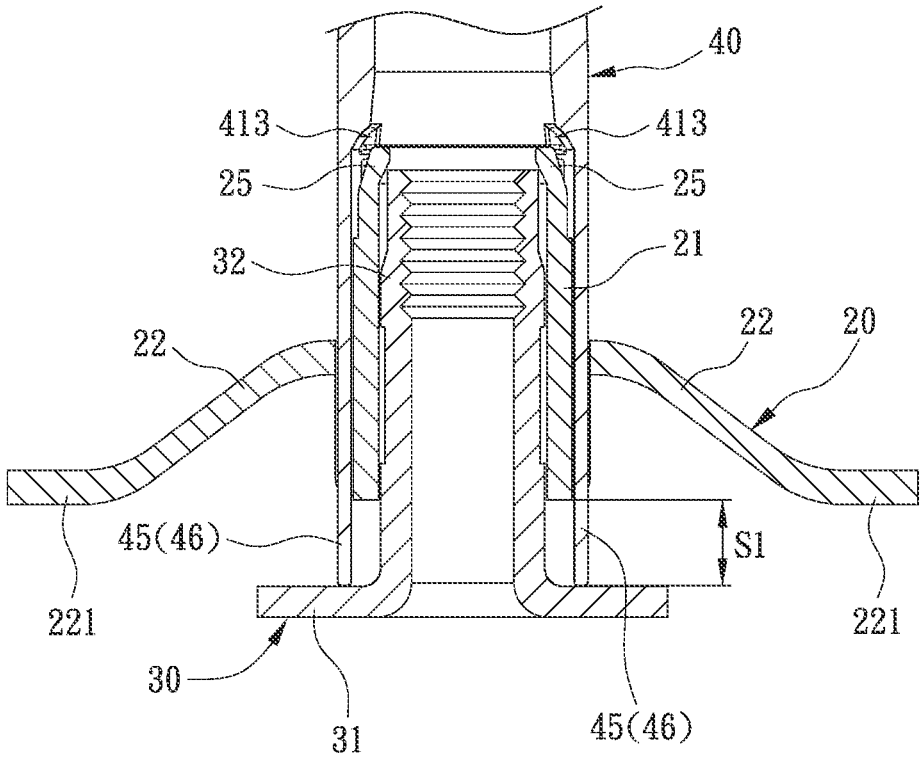
FIG. 29 is another cross sectional view showing the operation of the connection assembly for the toilet according to the fourth embodiment of the present invention.

Referring to FIG. 29, to avoid the head 31 of the respective one T-shaped screw nut 30 contacting with the inner wall of the through orifice 121, in a fifth embodiment, the respective one guider 40, 40*a* includes at least one definition sheet 45 extending from the bottom of the respective one guider 40, 40*a* to pass through the respective one flexible wing 22 of the respective one positioning element 20. When the respective one positioning element 20 is pressed, the at least one definition sheet 45 is forced to abut against the head 31 of the respective one T-shaped screw nut 30, and a smallest fixing distance Si between the head 31 and the locating portion 21 produces.

To avoid an oblique of the respective one guider 40, 40*a* when fixing the toilet 2, the respective one guider 40, 40*a* includes at least two securing ribs 46 extending downward from the bottom thereof, as illustrated in FIGS. 10-12, such that a respective one securing rib 46 is configured to insert through the respective one flexible wing 22 of the respective one positioning element 20 to enhance a security of the respective one guider 40, 40*a* and the respective one positioning element 20, thus fixing the toilet 2 smoothly. The respective one securing rib 46 is comprised of two fixers 400 configured to be used as the at least one definition sheet 45, thus limiting a height and avoid the oblique.

Accordingly, the connection assembly of the present invention has advantages as follows:

1) The respective one locking element 50 is screwed with the respective one T-shaped screw nut 30 via the respective one fixing orifice 2*a* of the toilet 2, so the length of the screw bolt 50*b* of the respective one locking element 50 is long to screw the screw bolt 50*b* with the respective one T-shaped screw nut 30, the shank 55 of the screw bolt 50*b* of the respective one locking element 50 is extended to locate below the toilet flange 10, thus preventing exposing of the shank 55 to achieve the aesthetics appearance.

2) The respective one guider 40, 40*a* is connected on the locating portion 21 of the respective one positioning element 20 so that when fixing the toilet 2, the respective one fixing orifice 2*a* is aligned with and receives the respective one guider 40, 40*a* so that the toilet 2 is fixed exactly and a part or all of the respective one guider 40, 40*a* is removed, the respective one locking element 50 is screwed with the respective one T-shaped screw nut 30 of the locating portion 21 of the respective one positioning element 20 to fix the toilet 2 exactly and quickly.

3) The respective one flexible wing 22 one-piece extends from the respective one positioning element 20 so that when the respective one flexible wing 22 is pressed to deform flexibly, the respective one T-shaped screw nut 30 is inserted through the through orifice 121 of the toilet flange 10 and is slid into the elongated slot 122 of the toilet flange 10. After the respective one flexible wing 22 is released, the T-shaped screw nut 30 and the respective one positioning element 20 are fixed on the annular fringe 10*b* of the toilet flange 10 easily and quickly.

4) The respective one guider 40 or 40*a* is applied based on the using requirements to comply with the height between the toilet flange 10 and the floor 1, for example, when the respective one guider 40*a* is applied, a part of the respective one guider 40*a*, i.e.

the tubular seat 401 is maintained and is configured to guide the screw bolt 50*b* of the respective one locking element 50 to the respective one T-shaped screw nut 30 exactly and quickly.

5) The rotary knob 50*a* is rotated manually to screw with the screw bolt 50*b* tightly, and the specific hand tool rotates the screw bolt 50*b* to actuate the rotary knob 50*a* to force the respective one fixing orifice 2*a* of the toilet 2, thus fixing the toilet 2 easily and quickly.

6) The respective one decoration 70, 70*a* is configured to cover at least one part or all of the rotary knob 50*a* and the head 54 of the screw bolt 50*b* of the respective one locking element 50, thus enhancing the aesthetics appearance and the tight sealing effect to avoid the corrosion of the head 54.

While the preferred embodiments of the invention have been set forth for the purpose of disclosure, modifications of the disclosed embodiments of the invention as well as other embodiments thereof may occur to those skilled in the art. The scope of the claims should not be limited by the preferred embodiments set forth in the examples, but should be given the broadest interpretation consistent with the description as a whole.

What is claimed is:

1. A connection assembly for a toilet comprising:

a toilet flange fixed on a floor of a building, and the toilet flange including a hub configured to connect with a feces discharge tube, an annular fringe connected on a top of the hub, two receiving grooves defined on two opposite sides of the annular fringe, two through orifices formed on the two receiving grooves, and an elongated slot communicating with the two through orifices;

two positioning elements, a respective one positioning element including a locating portion and two flexible wings one-piece extending from two opposite sides of the locating portion of the respective one positioning element; the locating portion of the respective one positioning element having a passing orifice; a respective one flexible wing being configured to abut against a top fence of the toilet flange;

two T-shaped screw nuts, a respective one T-shaped screw nut including a head and a tubular extension connected with the head, wherein the head is limited to not rotate after being inserted through a respective one through orifice of a respective one receiving groove and is slid to a desired position by moving the tubular extension along the elongated slot of the respective one receiving groove, and the head is limited on a bottom fence of the elongated slot of the annular fringe; the tubular extension is fixed after extending the passing orifice of the respective one positioning element, and after the respective one flexible wing abuts against the top fence of the toilet flange, the respective one positioning element and the respective one T-shaped screw nut are forced by the respective one flexible wing to engage on the annular fringe;

two guiders, a respective one guider being removably fixed on the locating portion of the respective one positioning element so as to be further received in a respective one fixing orifice of two fixing orifices of the toilet;

two locking element, a respective one locking element being screwed with the threaded orifice of the respective one T-shaped screw nut, after at least one part of the respective one guider is removed, and the toilet is locked on the toilet flange.

2. The connection assembly as claimed in claim 1, wherein the head of the respective one T-shaped screw nut has two long fringes and two short fringe; the annular fringe of the toilet flange has a limiting cliff extending downward from the annular fringe, an inner wall of the limiting cliff abuts against one of the two long fringes of the head of the respective one T-shaped screw nut, thus limiting a rotation of the respective one T-shaped screw nut.

3. The connection assembly as claimed in claim 1, wherein the tubular extension has a groove defined on an outer wall thereof, and the passing orifice of the locating portion of the respective one positioning element has at least two flexible hooks extending from the passing orifice, such that the at least two flexible hooks engage with the groove so that the tubular extension is fixed after extending into the passing orifice of the respective one positioning element.

4. The connection assembly as claimed in claim 1, wherein the respective one guider includes a notch defined on a bottom thereof and engaged with the locating portion of the respective one positioning element, the respective one guider includes a conical section having a tip and configured to align with and guide the respective one fixing orifice of the toilet, and the respective one guider is removed after the toilet is fixed.

5. The connection assembly as claimed in claim 4, wherein one of an inner wall of the notch of the respective one guider and an outer wall of the locating portion has the multiple longitudinal recesses, and the other of the inner wall of the notch of the respective one guider and the outer wall of the locating portion has multiple vertical ribs extending from an outer wall of the locating portion and configured to engage in the multiple longitudinal recesses.

6. The connection assembly as claimed in claim 4, wherein the outer wall of the locating portion has multiple vertical ribs, and the respective one flexible wing of the respective one positioning element has multiple cutouts surrounding the locating portion; the inner wall of the notch of the respective one guider has multiple the longitudinal recesses to engage with the multiple vertical ribs, and the notch of the respective one guider has multiple tabs extending downward therearound and configured to be received in the multiple cutouts.

7. The connection assembly as claimed in claim 4, wherein the notch of the respective one guider has at least two flexible hooks formed on at least two sides of the notch, and the locating portion of the respective one positioning element has at least two depressions formed on at least two opposite outer walls of the locating portion and configured to engage with the at least two flexible hooks.

8. The connection assembly as claimed in claim 7, wherein the locating portion of the respective one positioning element has multiple vertical ribs extending from an outer wall of the locating portion; and the notch of the respective one guider has multiple longitudinal recesses defined on an inner wall thereof and configured to engage with the multiple vertical ribs of the locating portion of the respective one positioning element.

9. The connection assembly as claimed in claim 1, wherein the locating portion of the respective one positioning element further has a central defining portion formed on a bottom of the locating portion and configured to be received in the elongated slot of the respective one receiving groove, thus limiting a rotation of the respective one positioning element.

10. The connection assembly as claimed in claim 9, wherein the locating portion of the respective one positioning element has two central protrusions one-piece extending from two opposite sides of the bottom of the locating portion, and the central defining portion is defined by the two central protrusions, wherein a respective one central protrusion of the two central protrusions is limited on a peripheral face of the elongated slot of the respective one receiving groove.

11. The connection assembly as claimed in claim 1, wherein the respective one flexible wing of the respective one positioning element has a limitation projection configured to be received in the elongated slot of the respective one receiving groove and contacts with the peripheral face of the elongated slot, thus limiting a rotation of the respective one positioning element.

12. The connection assembly as claimed in claim 4, wherein the respective one guider is a sole component.

13. The connection assembly as claimed in claim 4, wherein the respective one guider includes two components which are a tubular seat and a guiding seat removably connected on the tubular seat; the tubular seat has a conducting orifice configured to guide the respective one locking element, and the tubular seat has the notch defined below and communicating with the conducting orifice, the guiding seat is removed and the tubular seat is maintained after fixing the toilet.

14. The connection assembly as claimed in claim 13, wherein the tubular seat has a retaining trench defined on a top thereof and surrounding the conducting orifice, and two vertical trenches formed on two opposite sides of the retaining trench; the guiding seat has an engagement cliff extending on a bottom thereof and configured to engage in the retaining trench, and the guiding seat has two longitudinal protrusions extending from two opposite sides of an outer wall of the engagement cliff and slidably received in the two vertical trenches.

15. The connection assembly as claimed in claim 4, wherein the respective one guider has an abutting portion formed proximate to a top of the notch; and the locating portion of the respective one positioning element has a flexible retracting portion formed on a top of the locating portion, such that when the locating portion of the respective one positioning element is pressed, the abutting portion abuts against the flexible retracting portion to stop the tubular extension of the respective one T-shaped screw nut, so a smallest fixing distance between the head and the locating portion produces.

16. The connection assembly as claimed in claim 15, wherein the respective one guider includes at least two securing ribs extending downward from the bottom thereof and configured to insert through the respective one flexible wing of the locating portion of the respective one positioning element.

17. The connection assembly as claimed in claim 4, wherein the respective one guider includes at least one definition sheet extending from the bottom of the respective one guider to pass through the respective one flexible wing of the respective one positioning element; when the respective one positioning element is pressed, the at least one definition sheet is forced to abut against the head of the respective one T-shaped screw nut, and a smallest fixing distance between the head and the locating portion produces.

18. The connection assembly as claimed in claim 1, wherein the respective one locking element includes a rotary knob and a screw bolt, a top fence of the rotary knob has an accommodation trench defined thereon, and the accommodation trench has an aperture; the screw bolt has a head and a shank; the shank is inserted through the aperture of the accommodation trench of the rotary knob and is screwed with the respective one T-shape screw nut; the head is limited in the accommodation trench to not rotate so that the rotary knob actuates the screw bolt to revolve.

19. The connection assembly as claimed in claim 18, wherein the head of the screw bolt is non-circular, and a profile of the accommodation trench mates with a profile of the head so that the head is matingly engaged in the accommodation trench.

20. The connection assembly as claimed in claim 18, wherein the rotary knob includes at least two flexible hooks formed around the accommodation trench of the rotary knob so that the at least two flexible hooks hook the head in the accommodation trench of the respective one locking element.

21. The connection assembly as claimed in claim 18, wherein further comprising two decoration caps, wherein a respective one decoration cap is engaged on the top fence of the rotary knob so that at least one part of the top fence of the rotary knob is covered in the respective one decoration cap with the head of the screw bolt of the respective one locking element.

22. The connection assembly as claimed in claim 21, wherein the top fence of the rotary knob has a surrounding trench defined thereon; the respective one decoration cap includes an external fence and an extending rib extending from an inner side of a bottom of the external fence and configured to engage in the surrounding trench, wherein the external fence is located outside the rotary knob so that the rotary knob is covered in the respective one decoration cap with the head of the screw bolt.

23. The connection assembly as claimed in claim 21, wherein the top fence of the rotary knob has a surrounding trench defined thereon; the respective one decoration cap includes an external fence configured to engage in the surrounding trench so that at least one part of the rotary knob is covered in the respective one decoration cap with the head of the screw bolt of the respective one locking element.

24. The connection assembly as claimed in claim 1 further comprising two washers, and a respective one washer is defined between the head of the screw bolt and the respective one fixing orifice of the toilet.

* * * * *